US012680302B2

(12) United States Patent
Goswami et al.

(10) Patent No.: US 12,680,302 B2
(45) Date of Patent: Jul. 14, 2026

(54) STRUCTURAL COMPONENT FOR SUPPORTING CONSTRUCTION PANELS AND A WALL COMPRISING THE SAME

(71) Applicant: SAINT-GOBAIN PLACO, Courbevoie (FR)

(72) Inventors: Shailee Goswami, Chennai (IN); Kanakavel S, Chennai (IN)

(73) Assignee: SAINT-GOBAIN PLACO, Courbevoie (FR)

( * ) Notice: Subject to any disclaimer, the term of this patent is extended or adjusted under 35 U.S.C. 154(b) by 408 days.

(21) Appl. No.: 18/573,286

(22) PCT Filed: May 20, 2022

(86) PCT No.: PCT/IN2022/050481
§ 371 (c)(1),
(2) Date: Dec. 21, 2023

(87) PCT Pub. No.: WO2022/254452
PCT Pub. Date: Dec. 8, 2022

(65) Prior Publication Data

US 2024/0200332 A1 Jun. 20, 2024

(30) Foreign Application Priority Data

Jun. 3, 2021 (IN) ..... 202141024748

(51) Int. Cl.
*E04C 3/07* (2006.01)
*E04C 3/04* (2006.01)

(52) U.S. Cl.
CPC ..... *E04C 3/07* (2013.01); *E04C 2003/0413* (2013.01); *E04C 2003/0452* (2013.01)

(58) Field of Classification Search
CPC ..... E04C 3/07; E04C 2003/0413
See application file for complete search history.

(56) References Cited

U.S. PATENT DOCUMENTS 3,526,031 A * 9/1970 Truitt ..... B23K 9/0026 228/181
3,534,463 A * 10/1970 Molin ..... B21D 47/00 52/394

(Continued)

FOREIGN PATENT DOCUMENTS

CN 110306724 A 10/2019

OTHER PUBLICATIONS

International Preliminary Report on Patentability in International Patent Application No. PCT/IN2022/050481, dated Nov. 21, 2023.

(Continued)

*Primary Examiner* — Joshua K Ihezie
(74) *Attorney, Agent, or Firm* — McDonnell Boehnen Hulbert & Berghoff LLP

(57) ABSTRACT

A structural component (100) for supporting construction panels is disclosed comprising an I-shaped strip having two parallel strips (P1. P2) and at least one strip (S1) perpendicular to (P1) and (P2). One or both the parallel strips (P1. P2) contain a plurality of substantially flat portions (110) and void portions (120) which alternate in a first direction X along the structural component (100). The flat portions (110) are configured to support the construction panel in plane contact while the void portions (120) are configured to support the construction panels in line contact. The void portions (120) reduce the thermal transmission of the structural component (100) by providing reduced thermal bridges in the transmission path of heat and reducing the contact surface area with adjoining adjacent materials. The structural component (100) described is a drywall stud or a spacer separating two parallelly bonded construction panels.

28 Claims, 5 Drawing Sheets

(56) References Cited

U.S. PATENT DOCUMENTS

| | | | | |
|---|---|---|---|---|
| 3,812,558 | A * | 5/1974 | Watanabe | B21D 47/02 29/6.1 |
| 5,360,500 | A * | 11/1994 | Evans | C04B 35/83 423/447.4 |
| 5,551,135 | A * | 9/1996 | Powers, III | E04H 1/1205 29/6.1 |
| 5,592,796 | A | 1/1997 | Landers | |
| 7,617,648 | B2 * | 11/2009 | Moody | E04B 2/7457 52/656.1 |
| 9,174,264 | B2 * | 11/2015 | Anderson | B21D 47/02 |
| 10,378,207 | B2 * | 8/2019 | Gonda | E04H 12/02 |
| 2005/0126852 | A1 * | 6/2005 | Nakajima | B29C 66/73921 181/293 |
| 2006/0185315 | A1 | 8/2006 | Walker | |
| 2007/0020441 | A1 * | 1/2007 | Kim | E04C 2/365 428/137 |
| 2008/0307729 | A1 * | 12/2008 | Maimon | E04C 2/365 52/309.1 |
| 2009/0255205 | A1 * | 10/2009 | Noble | B32B 21/10 52/630 |
| 2010/0236759 | A1 * | 9/2010 | Wadley | E04C 2/3405 165/104.19 |
| 2018/0037342 | A1 * | 2/2018 | Dong | B64C 1/064 |
| 2018/0038103 | A1 * | 2/2018 | Neumayr | E04C 2/46 |
| 2023/0358042 | A1 * | 11/2023 | Schaap | E04C 2/32 |
| 2024/0200332 | A1 * | 6/2024 | Goswami | E04C 3/07 |

OTHER PUBLICATIONS

International Search Report and Written Opinion in International Patent Application No. PCT/IN2022/050481, dated Sep. 5, 2022.

* cited by examiner

STRUCTURAL COMPONENT FOR SUPPORTING CONSTRUCTION PANELS AND A WALL COMPRISING THE SAME

TECHNICAL FIELD

The present invention relates to a structural component, in particular, to a structural component for supporting construction panels installed on a wall framing assembly that reduces thermal conductivity between the said structural component and the adjoining construction panel. The present invention further relates to laminated construction panels made using said structural component.

BACKGROUND

Conventional C-studs are used in construction, for example, they are widely used for erecting dry walls throughout commercial and high rise construction. They are unsatisfactory for various reasons, most of which are well known. One of the primary problems associated with the use of C-studs involves high level of thermal transmission due to conductivity between the studs and the materials which they contact. The routes of transmission across a wall or partition are sometimes referred to as "thermal bridges". Therefore, in addition to structural stability requirements that a framing assembly involving C-studs should meet, thermal characteristics are also important, especially for exterior walls. Minimizing the heat transfer through the walls is desirable both for comfort and for energy efficiency of heating and air conditioning.

Similarly, to the "thermal bridges" referred to above, acoustic transmission can also occur across studs via "acoustic bridges", whereby acoustic oscillations in elements in contact with the stud can be transmitted across the stud to other elements of the wall or partition. Therefore, acoustic characteristics which minimize the sound transfer through walls are also important in walls and partitions for maintaining suitable comfort and meeting required regulation.

The degree of prevention of heat or sound transfer may be based on considerations of technical feasibility, structural requirements as well as cost. Heat and sound transfer through drywalls may be addressed in a variety of ways including insulating drywall cavities. However, such and other insulation methods do not address the conduction occurring through the components themselves, which present a direct and continuous path for heat and sound transfer across the drywalls.

Alternatively, studs can be made with spaced apart openings, so as to reduce thermal and acoustic conductivity. Studs can also be made with various flanges and ridges to make them more rigid. However, in the past such studs have been more expensive than traditional C-studs and have not found wide acceptance. It is apparent that forming studs with complex openings, ribs, and ridges will be costlier than rolling simple C-studs.

A number of attempts to achieve the above said outcomes have been proposed. However, all of these prior proposals suffer from significant disadvantages that severely limit and in some cases eliminate their practical application and use. For example, U.S. Pat. No. 5,592,796 relates to a thermally-improved metallic channel comprising inwardly-bent depressions on one or more flanges extending at generally perpendicular angles from the web. These depressions form contact ridges that are used as bearing surfaces against adjacent materials during installation. The contact ridges along with the air space resulting from the inwardly-bent depressions decrease the rate of heat loss or heat gain due to conductivity.

Likewise, U.S. Pat. No. 7,617,648 relates to a thermal framing component including an elongated web with tabs in alternating positions bent at right angles to the web. The bent tabs form slots on both sides of the web into which rigid insulation is reciprocally received. U.S. Pat. No. 9,174,264 is yet another patent that relates to a framing member having a series of web slots that create voids to minimize thermal transmission from the exterior to the interior of a wall and provide adequate structural properties. Although such components are intended to avoid direct paths for conduction of heat through the wall, the contact surface area with the adjoining board remains unaltered and hence there is potential for further reducing conduction compared to the teachings of these documents.

Similar to the importance of thermal conductivity to exterior drywalls, sound insulation is important for interior partition walls. Slots or small punctures in the C-stud profile is one of the popular means of disrupting the propagation of heat and sound through the walls as shown for example, in U.S. Publication 2006185315. The two sidewalls of the wall stud are interconnected by a spanning web that includes first and second portions connected to respective sidewalls and being connected themselves by a curved member, preferable of semi-circular shape. This curved member along with the rows of longitudinal slots formed are aimed at providing reduced thermal bridges in the transmission path of the sound vibrations.

All prior art stud design modifications add to the complexity of manufacturing, fabrication and limits the ability to make on-site modifications. For the foregoing reasons, there exists a need for framing components that limit heat transfers through the drywall and in particular direct conduction through the drywall framing system, is relatively easy to manufacture, is easy and quick to transport and install, not costlier than the conventional components and further one that meets the structural requirements in spite of involving less material by way of thinning or reduced material usage.

There is still need in the art to develop multifunctional components, especially one that is beneficial for interior and exterior applications such as to achieve reduced heat transfer particularly in exterior walls and sound insulation more particularly in interior walls.

Thus the present disclosure provides a structural component for supporting construction panels used in interior as well as exterior applications. Said structural component when used in a framing assembly reduces heat transmission between adjoining materials and further contributes to sound insulation when used as a spacer bonding two adjacently placed construction panels used in partitions. While contributing to said benefits, the structural component of the present disclosure is designed to retain required structural stability, ease of manufacture; transport; installation and cost effectiveness.

SUMMARY OF THE DISCLOSURE

In one aspect of the present disclosure, a structural component for supporting construction panels is disclosed comprising an I-shaped strip that comprises two parallel strips P1, P2 and at least one strip S1 arising perpendicular to P1 and P2. At least one of the two parallel strips P1, P2 contain a plurality of alternating substantially flat portions and void portions along direction X of the structural component. Each of said void portion contain a convex profile that is bordered by strip S1. Hence the strip S1 comprises a plurality of alternating concave sections C1 and convex sections C2. The flat portions of the structural component are configured to support the construction panels in plane contact.

In one other aspect of the present disclosure, a wall is disclosed comprising a framing assembly. The framing assembly comprises a horizontal framing member fixed to the floor; another horizontal framing member substantially parallel to and spaced from the horizontal framing member fixed to the floor and fixed to the ceiling 310; the structural components spaced vertically and mounted to the horizontal framing member at its bottom end and to the horizontal framing member at its top end; and a construction panel placed on one or either sides of the framing assembly. The structural components are mounted there between the horizontal framing members such that the substantially flat portions of the structural components abut and support the surface of the construction panel in plane contact and the void portions of the structural components abut and support the construction panels in line contact when the construction panel is fixed to one or either sides of the framing assembly 500.

In yet another aspect of the present disclosure, a laminated construction panel is disclosed. The laminated construction panel comprising two opposing construction panels separated and held together by a plurality of structural components spaced vertically there between. The substantially flat portions of the structural components support the construction panels in plane contact and the void portions support the construction panels in line contact defined by the perimeter of the void portions.

Other features and aspects of this disclosure will be apparent from the following description and the accompanying drawings.

BRIEF DESCRIPTION OF THE DRAWINGS

The present invention can be better understood, and its numerous features and advantages made apparent to those skilled in the art by referencing the accompanying drawings. Embodiments are illustrated by way of example and are not limited in the accompanying figures.

The use of the same reference symbols in different drawings indicates similar or identical items.

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiments of the invention.

Features and advantages of the present disclosure will become more apparent in light of the following detailed description of embodiment, as illustrated in the accompanying figures. As will be realized, the disclosure is capable of modifications in various respects, all without departing from the present disclosure. Accordingly, the drawings and the description are to be regarded as illustrative in nature, and not restrictive.

DETAILED DESCRIPTION

Wherever possible, the same reference numbers will be used throughout the drawings to refer to the same or similar parts. Embodiments disclosed herein are related to a structural component that reduces thermal conductance of components in drywall systems by limiting the area of contact between the said structural component and adjoining materials. The structural component of the present disclosure achieves reduced surface contact with adjoining materials while the standardized structural dimensions may be maintained. This is advantageous for the use of the said structural component in conjunction with standardized components of the framing system.

Hereinafter, exemplary embodiments of the present invention will be described in detail with reference to the accompanying drawings.

Figure 1:
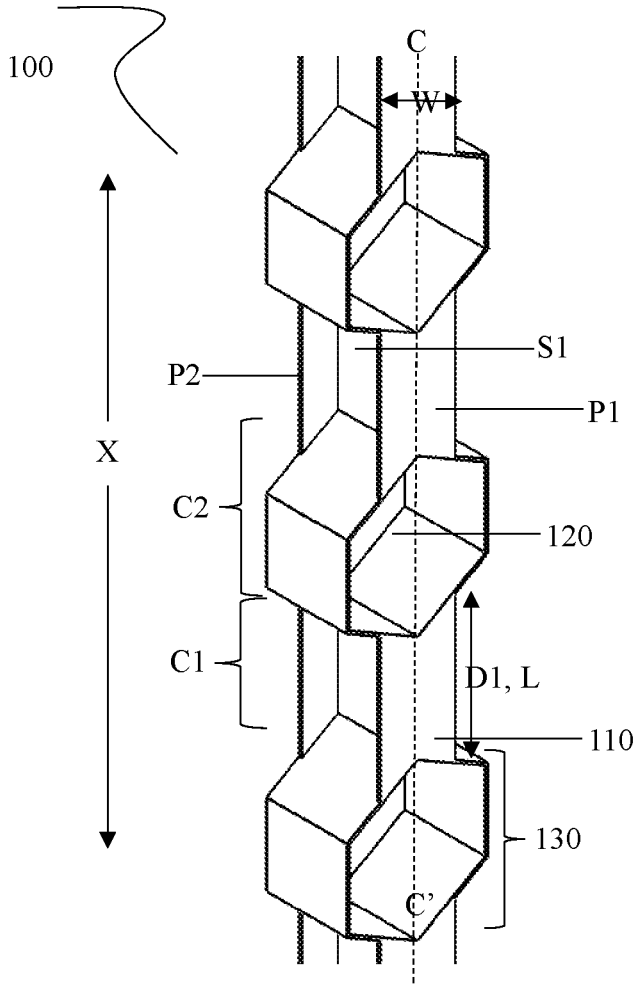
FIG. 1 illustrates a perspective view of a structural component, according to one embodiment of the present disclosure.

As previously explained the structural component has specific features adapted to facilitate low thermal transmission and provides for attachment of construction board in such a manner as to achieve said reduced thermal conduction. Illustrated in FIG. 1 is a perspective view of a structural component 100 for supporting construction panels. The structural component 100 is I-shaped comprising two strips: first strip P1 and second strip P2. The strips P1, P2 are substantially parallel to one another and/or substantially equal in width, their length being equal to the length of the structural component 100 and therefore equivalent to the height of the wall being constructed. Interconnecting the strips P1, P2 is a perpendicularly rising strip S1. The embodiment shown in FIG. 1 shows the perpendicular strip S1 to arise centrally there between the two parallel strips P1, P2. However, in alternate embodiments of the present disclosure, there can be two perpendicular strips S1, S1' (not shown) arising from respective peripheral edges of the strips P1, P2.

It can be seen that the strips P1, P2 have a number of alternating substantial flat portions 110 and void portions 120 formed along the length of the structural component 100 in a first direction X. The void portions 120 are formed by the perpendicular strip S1 being shaped into a convex profile 130. The strip S1 contains concave sections C1 and convex sections C2. Contrary to expectations, it has been found that the provision of void portions 120 do not significantly weaken the structural component 100 when compared to a conventional standard "C" stud used in construction industry. It is understood that the substantial flat portions 110 introduces sufficient resilience to the structural component 100 to retain the structural stability requirement. The substantial flat portions 110 contribute to the stiffness of the parallel strips P1, P2 making it easier to attach construction panels to them, for examples using screws. It is further understood that the void portions 120 reduce the thermal transmittance of the structural component 100 by providing reduced thermal bridges in the transmission path of heat and reducing the contact surface area with adjoining adjacent materials. The void portions 120 further reduce the material used in making the structural component 100.

The convex profile 130 of the void portion 120 according to multiple embodiments of the present invention can be polygonal, elliptical, circular or hexagonal shaped. In the illustrated embodiments, the void portions 120 are preferred to be hexagonal. However, other profile shapes may be utilized in conjunction with appropriate materials and the illustrated embodiments are not to be considered as limiting the scope of the present invention. The shape and configuration of the void portion 120 can be adjusted to any shape or depth in order to achieve the desired objectives.

As can be seen from FIG. 1, the substantially flat portions 110 of first parallel strip P1 is substantially parallel to the substantially flat portions 110' of the second parallel strip P2 so as to form forms an I-shape with the perpendicular S1. Likewise, the void portions 120 of the first parallel strip P1 converging with the void portions 120' of the second parallel strip P2. However, in alternate embodiments, only one of the strips P1, P2 can be designed to have the alternating substantial flat portions 110 and void portions 120 formed along the length of the structural component 100 in the first direction X. In such an embodiment, the void portions 120 are present on one of the strips P1 or P2 while the corresponding portion opposite the said strip is closed and not void. While the structural component 100 of such an embodiment also contributes to reducing the thermal transmission, its U-value may not be as low as that of a structural component bearing void portions on both the parallel strips P1, P2 for obvious reasons.

The preferred dimensions of the structural component 100 are as follows: The width of each void portion 120 is greater than the width of flat portions 110. Both the width of the void portion 120 and the width of flat portions 110 are measured in a direction perpendicular to the first direction X and parallel to P1 and P2. According to preferred embodiments of the present invention, a void portion 120 is present between neighboring pairs of substantial flat portions 110. Hence, the distance D1 between consecutive void portions 120 along the direction of the first axis X ranges between 30 mm to 75 mm. The substantial flat portions 110 has a width W ranging between 30 mm to 100 mm. The length L of the substantial flat portions 110 may be less or equal to the distance D1 between two consecutive void portions 120.

Figures 2A, 2B:
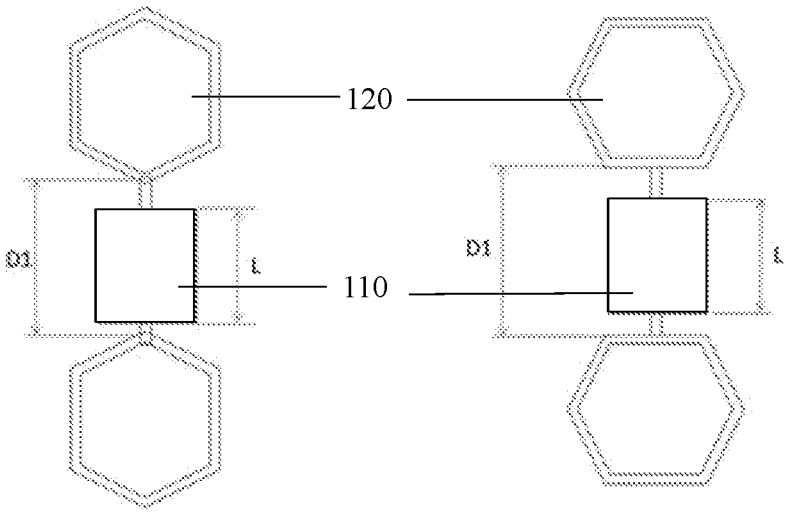
FIG. 2A illustrate fragmentary, front view of structural component, according to another embodiment of the present disclosure.
FIG. 2B illustrate fragmentary, front view of structural component, according to yet another embodiment of the present disclosure.

In certain embodiments of the present invention, where the length L of substantial flat portions 110 is less than the distance D1, then the flat portions 110 may be formed centrally, or towards either sides of the adjacent void portions 120. Two such embodiments are shown in FIG. 2A and FIG. 2B which demonstrate the two-dimensional front view of the exemplary structural component 100. While FIG. 2B shows the substantial flat portions 110 to be central to the neighboring void portions 120, FIG. 2A shows the substantial flat portion 110 to be more closely position towards one of the void portions 120. In such cases the substantial flat portions 110 are linked to the void portions 120 by additional stretch of materials having reduced width when compared to W.

According to one preferred embodiment of the present invention, the distance D1 between two consecutive void portions 120 is equal to the length L of the substantial flat portions 110.

The thickness of the strips P1, P2, S1 or sheet members forming the structural component 100 varies from 0.4 mm to 1.7 mm in conjunction with the appropriate material used for making the structural component 100. The structural component 100 can be made from plastic, polymer, cardboard, wood, steel or other metals such as gauge galvanized steel or a combination thereof. Likewise, the structural component 100 can be manufactured in whole or in part through a roll forming process, yet again decided in conjunction with the appropriate material making the structural component 100. Alternatively, a stamping process can be used to manufacture the structural component 100 in whole or in part. Alternatively, the structural component 100 can even be manufactured in whole or in part by 3-D printing process.

The structural component 100 can be manufactured by a process, for example, that includes passing a sheet of any of the above said material from a coil through a series of form rollers that create the structural shape of the structural component 100. The dimensions of the flat portions 110, void portions 120, depth of the strip S1 and profile shapes of the void can all be adjusted to accommodate any desired design variations that enhances the thermal performance, cost reduction, structural enhancement or any other desired objective not currently realized.

Figure 3:
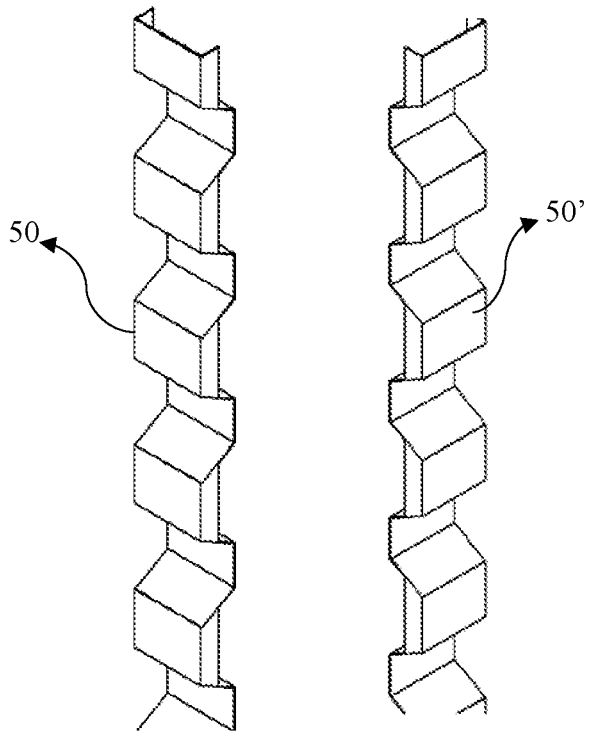
FIG. 3 shows the schematic of a structural component manufactured in part, according to one embodiment of the present disclosure.

In an alternate embodiment of the present disclosure, the structural component 100 can be made by joining two identical parts 50, 50' of the said component 100 formed when the component 100 is cut across its central axis denoted by dotted lines C-C' in FIG. 1. In such an embodiment as schematically shown in FIG. 3, the void portions 120 are halved, such that when the two identical parts 50, 50' are brought together with their corresponding concave sections C1 adjacent to each other, the respective convex sections C2 form a complete void portion 120. In such an embodiment, the identical parts 50, 50' can be joined together by mechanical fasteners or adhesive fasteners or other conventional means of fastening depending on the material making the identical parts 50, 50'. In embodiments, involving a single perpendicular strip S1, the identical parts 50, 50' are joined, fastened, crimped or glued at the said perpendicular strip S1 such that the strips abut each other. In embodiments, involving two perpendicular strips S1, S1', the identical parts 50, 50' are joined, fastened or crimped or clinched or joined by sheet metal joining techniques to form an enclosed structure formed by the adjacently placed portions of the two perpendicular strips S1, S1'.

In the above said embodiment, the substantially flat portions 110 of one identical part 50 is substantially parallel to the substantially flat portions 110' of the second identical part 50' so as to form an I-shape with the perpendicular S1. Likewise, the void portions 120 of the identical part 50 converges with the void portions 120' of the second identical part 50' thereby completing the void of any desired shape.

In all embodiments of the present invention, the substantial flat portions 110 of the structural component 100 is configured to support construction panels in plane contact. While the void portions 120 of the structural component 100 is configured to support construction panels in line contact defined by the perimeter of the void portions 120 bordered by the strip S1. Hence the void portions 120 significantly contribute to reducing the contact surface area between the structural component 100 and adjoining material viz., construction panels.

The heat transferred, over a given time span, must depend, both on the temperature gradient across the structural component 100, and also the volume of material providing a heat transfer path. The void portions 120 provide the smallest volume of material at the said locations, for transmission of heat across the structural component 100. Thus whatever heat gradient exists across the structural component 100, heat transmission from one edge to the other of the structural component 100 must be restricted to whatever heat values can be transmitted at the perimeter of the void portions 120.

The reduction in heat transmission values for the structural component 100 compared with conventional standard "C" studs, from one edge to the other of the stud, can be seen from the following table 1 which compares two external wall systems (comprising two boards, stone wool insulation, two air gaps, and metal stud) (with thermal bridging) using the calculation method of ISO 6946:2007. The conventional standard "C" studs and the structural component 100 being made from steel.

TABLE 1

| Heat Transmission Value | | |
|---|---|---|
| | Width | U-value |
| Conventional standard "C" stud | 70 mm | 0.67 $W/m^2K$ |
| Structural Component 100 | 70 mm | 0.42 $W/m^2K$ |

According to multiple embodiments of the present invention, the structural component 100 is a drywall stud or a spacer separating two parallelly bonded construction panels.

Figure 4:
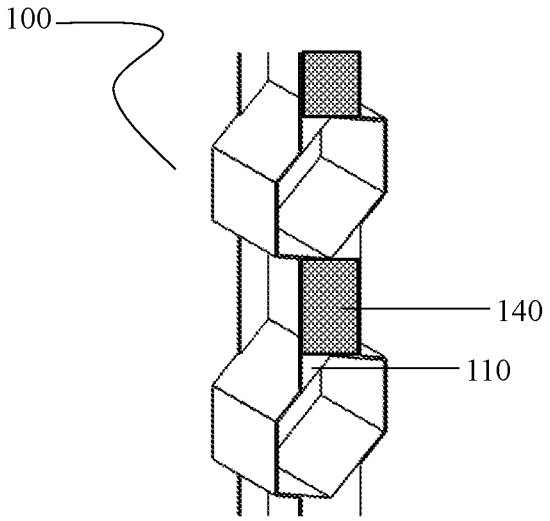
FIG. 4 shows a fragmentary perspective view of a structural component, according to yet another embodiment of the present disclosure.

FIG. 4 shows an alternative embodiment of the structural component 100 according to the present invention in which insulation strips 140 can be seen attached to the substantial flat portions 110 of the structural component 100. The insulation strip 140 can be applied on substantial flat portions 110 of one or both strips P1, P2 by adhesive, staples, nails or other similar fasteners. The insulation strip 140 helps in further reducing the conduction gains from the structural component 100 to the adjoining materials. The insulation strip 140 can be made of wood, plastic, or other materials that can function as both a thermal insulated barrier, fire resistant and exhibit characteristics that would allow conventional nailing. This can allow the use of nail guns and other automated tools normally used for attaching the structural members together and sheathing to portions of structural members.

Any conventional insulation materials such as Ethylene propylene diene monomer (EPDM) or other traditionally known insulation material can be used for this purpose. In a preferred exemplary embodiment, an e.g. 4 mm thick EPDM sheet is adhesively bonded to the substantial flat portions 110 of both the parallel strips P1, P2 on-site. In another exemplary embodiment, adhesion is done by spraying super 77™ marketed by 3M directly on the surface of the substantial flat portions 110.

In yet another alternative embodiment, heat or sound absorbing materials can be displaced in the void portions 120 substantially filling the space bordered by the strip S1. Such sound absorbing material can be fibreglass insulation, spun bonded polyester wool, stone wool insulation or any other suitable material and can reduce the sound transmission across the structural component 100 by approximately 1 dB or 2 dB.

Because the design of the structural component 100 restricts heat transfer without significantly damaging the mechanical strength compared to a conventional standard "C" studs, the structural component 100 of the present invention is greatly superior to conventional standard "C" studs.

Figure 5A:
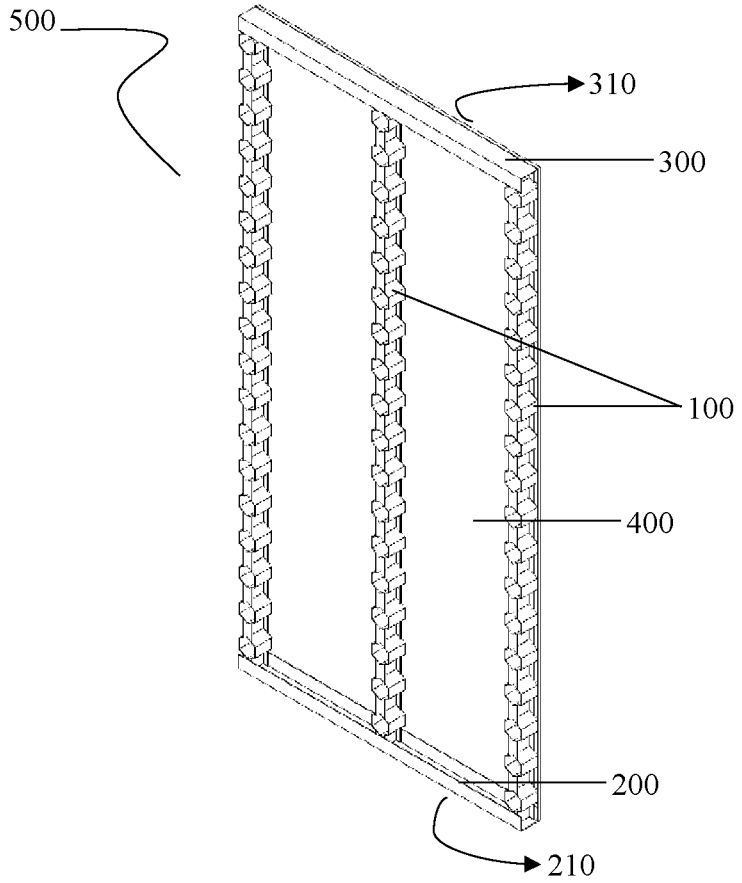
FIG. 5A illustrates a fragmentary, perspective view of a framing assembly comprising the structural component in said orientation, according to one embodiment of the present disclosure.

FIG. 5A shows a schematic of a framing assembly 500 of a construction wall comprising the structural component 100 of the present invention, according to one embodiment of the present teaching. The framing assembly 500 comprises two parallel horizontal framing members viz., a floor channel 200 fastened to the floor 210 and a ceiling channel 300 fastened to the ceiling 310. The fastening is typically accomplished by mechanical fasteners. The structural components 100 of the present invention are vertically spaced and mounted to the floor channel 200 at its bottom end and to the ceiling channel 300 at its top end. A construction panel 400 is generally affixed to at least one face of the framing assembly 500 using mechanical fasteners. In said embodiment, the structural components 100 are mounted such that the substantially flat portions 110 abut and support the surface of the construction panel 400 in plane contact and the void portions 120 abut and support the construction panels 400 in line contact when the construction panel 400 is fixed to one or either sides of the framing assembly 500.

Figure 6:
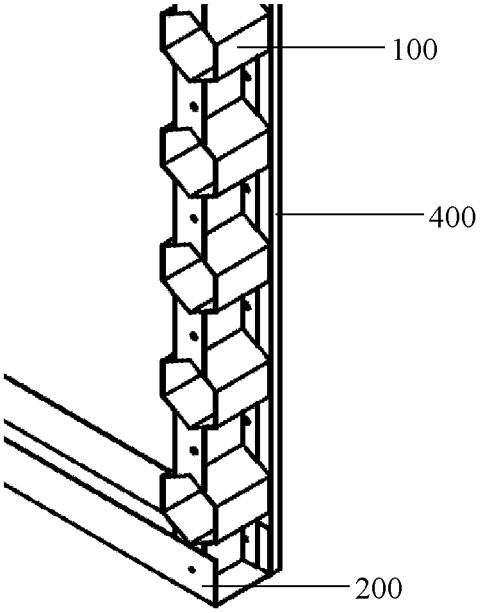
FIG. 6 shows a perspective view of the connection of the structural component of FIG. 5A to the construction panel in a framing assembly; according to one embodiment of the present disclosure.

The construction panel 400 is screwed to the substantial flat portions 110 at predetermined intervals and the substantially flat portions 110 at the bottom end of the structural components 100 are fixed to the floor channel 200 and at the top end of the structural components 100 are fixed to the ceiling channel 300, as demonstrated in the schematic shown in FIG. 6. In such an arrangement, the void portions 120 of the structural component 100 encloses an air cavity bounded by lines of contact established by the convex profile 130 abutting the construction panel 400. It is through this air cavity that the structural component 100 provides the reduced thermal transmittance to the framing assembly 500.

The strip S1 present perpendicularly there between the two parallel strips P1, P2 at the substantial flat portions 110 provides the necessary resilience to the structural components 100 against deflection, bending or breakage during fastening activities. The air cavity establishes a reduced contact area between the structural component 100 and the adjoining construction panels 400 that results from the incorporation of void portions 120 whereby thermal transmission due to conductivity is decreased. In other words, by incorporating structural components 100 into a framing assembly, the cumulative insulation value for said framing assembly is improved. Furthermore, the improvement is achieved without necessitating a dimensional modification of standardized framing systems or creating an obstruction for commonly used fastening devices.

In optional embodiments, an insulation material can be positioned within the air cavity formed by the void portions 120, the channels 200, 300 and the construction panel 400 and/or any conventional insulation materials such as Ethylene propylene diene monomer (EPDM) sheet can be adhesively bonded to the substantial flat portions 110 of both the parallel strips P1, P2. Such embodiments further contribute to decreasing sound and heat transmission through the framing assembly 500.

Figure 5B:
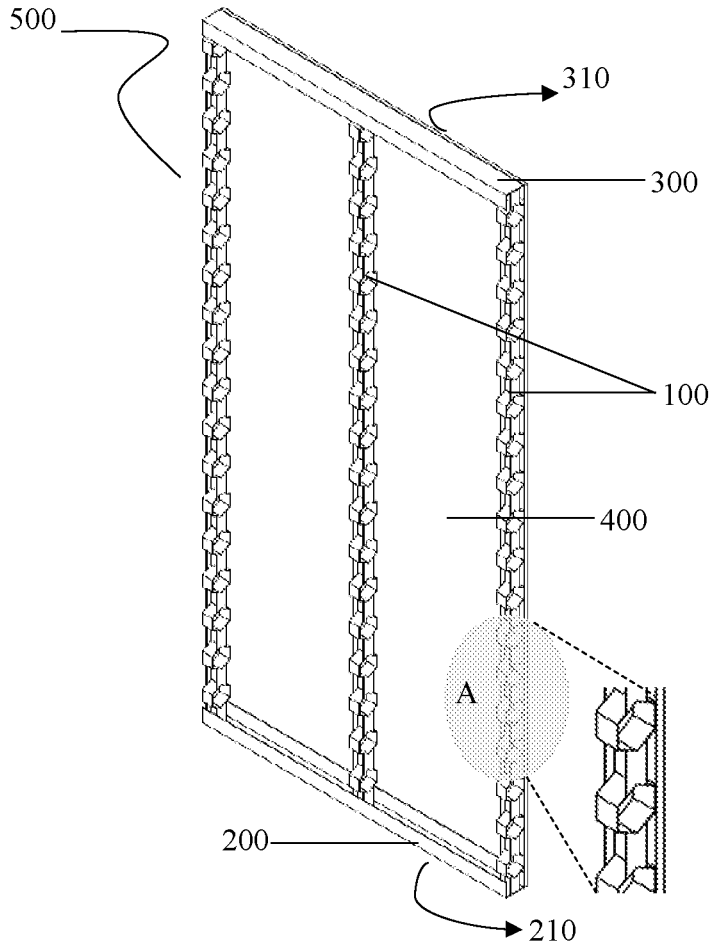
FIG. 5B illustrates a fragmentary, perspective view of a framing assembly comprising the structural component in another orientation, according to another embodiment of the present disclosure.

Alternatively, in another embodiment, the structural components 100 can be mounted in an orientation in which the void portion 120 abut the support the surface of the construction panel 400 in plane contact and the substantial flat portions 110 lie between lie there between the two construction panels 400 affixed to the framing assembly 500, as is illustrated in the schematic shown in FIG. 5B. Herein the construction panel 400 is screwed to the void portions 120 of the structural components 100 as can be seen in the call out image A. Such an orientation also reduces the contact surface area between the structural component 100 and the adjacent adjoining construction board 400 and thereby provides reduction in thermal conductivity gains.

The construction panel 400, according to multiple embodiments of the present invention is gypsum board or fiber cement board. In alternate embodiments, reinforced gypsum boards can also be used.

Figure 7:
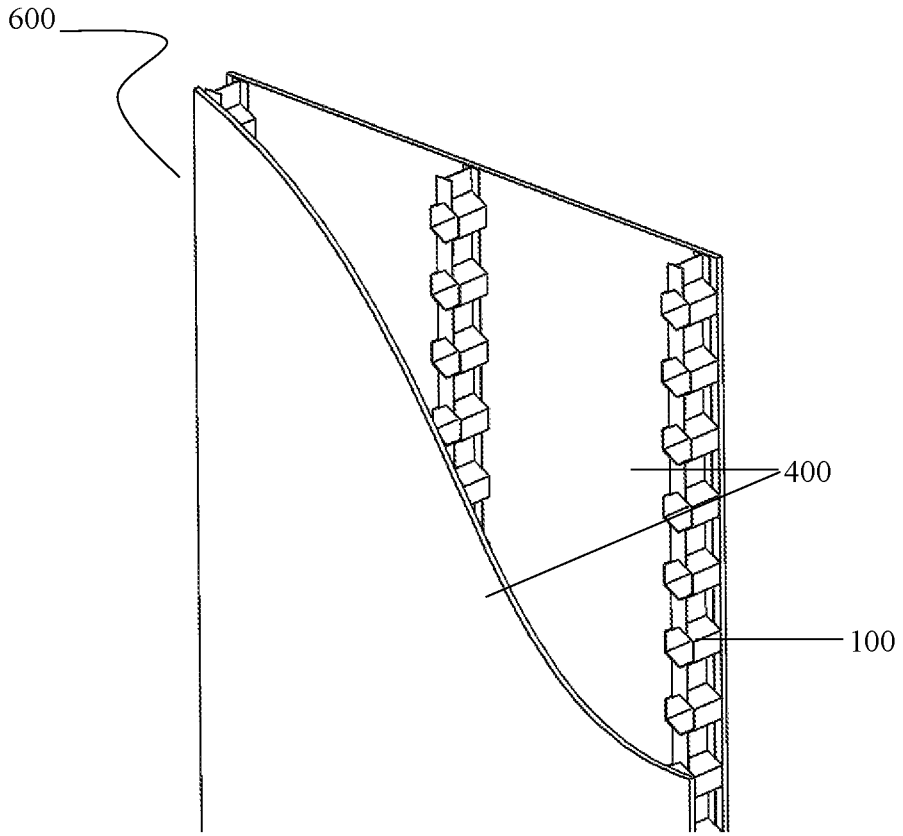
FIG. 7 demonstrates a fragmentary, sectional view of a laminated construction panel, according to one embodiment of the present disclosure.

Yet another application area for the structural component 100 of the present invention is the use of it as a spacer for making prefabricated laminated construction panels 600 comprised of two opposing construction panels 400 separated and held together by a plurality of structural components 100 there between adhesively or otherwise bonded to the construction panels 400 as shown in the schematic shown in FIG. 7. It can be seen that the substantially flat portions 110 of the structural components 100 support the construction panels in plane contact and the void portions 120 support the construction panels in line contact defined by the perimeter of the void portions 120.

EXAMPLES

Example 1

Deflection Testing:

A structural component 100 with 70 mm width and base material (sheet metal) thickness of 1.25 mm was obtained by simulation modeling using ANSYS software. For comparative analysis a conventional standard "C" stud was also modelled with 70 mm width and base metal thickness of 1 mm. A framing system comprising the said structural component and another comparative framing system with the conventional standard "C" stud were modelled at 2400 mm×1200 mm. an equal pressure of 350 Pa was applied on both the framing systems and the corresponding deflection seen in the systems were recorded and are tabulated below in Table 2:

TABLE 2

| Deflection Testing Results | | | |
|---|---|---|---|
| | System height in (mm) | System width in (mm) | Deflection in (mm) |
| Conventional standard "C" stud | 2400 | 1200 | 8.25 |
| Structural Component 100 | | | 8.04 |

It can be understood from the above values that the structural component 100 in spite of having void portions 120 as against the expected meets the structural stability requirement as that of a conventional standard "C" stud.

Example 2

Thermal Transmission Testing

A prototype comprising the structural component 100 was made as per the teachings of the preset invention and experiments were conducted to understand the heat transmission through the structural component 100. The prototype was prepared at 1×1 m using gypsum board fixed on either sides of the structural component 100. IR lamp was used to heat the structural component 100 from one side of the gypsum board for about 20 minutes. The temperature variation across the structural component 100 were captured using an IR camera. The same experimental set up was repeated with a prototype comprising a conventional standard "C" stud. The temperature measurement was repeated at different points on the gypsum board and the values are tabulated below in Table 3:

TABLE 3

| | Temperature (° C.) | | |
|---|---|---|---|
| Measurement points | Conventional standard "C" stud | Structural Component 100 | Variation |
| Point 1 | 26.6 | 25.5 | 1.1 |
| Point 2 | 28.0 | 26.2 | 1.8 |
| Point 3 | 26.3 | 25.6 | 0.7 |

Thus the structural component 100 proposed in the present invention can be seen to reduce the surface temperature by 1.8° C. at measurement point 2. The experiment above is conducted using an IR lamp that provides a single point source of heating, whereas in reality the heating would be uniform across the construction board affixed to the structural component 100 and will result in further reduction in surface temperature.

Industrial Applications

Thus the structural component 100 of the present invention is an economic (in terms of energy saving) component capable of reducing thermal loss and gain through conductivity with adjacent adjoining materials. In addition, the structural component 100 herein possess the following advantages:

- The structural component 100 of the invention to be used in conjunction with currently existing industry standardized framing systems without necessitating a modification of other system components;
- The substantial flat portions 110 allow the width of structural component 100 to remain consistent with standardized structural dimensions for commonly used framing members;
- The structural component 100 readily accommodates the use of mechanical fastening devices thereby eliminating deflection, bending or breakage of these devices due to any obstructions owing to its design;
- Although the structural component 100 may cost slightly more to make, they have additional benefits, such as being easier and quicker to install, and can be made of significantly thinner gauge, thus using less material, than simple C-section studs and as well retain structural stability in spite of the material reduction.

The structural component 100 of the present disclosure finds application in building constructions not limiting to commercial and residential spaces. The structural component 100 described in the present disclosure ensures reduced thermal transmission and enhanced structural performance with slight increase in material usage (which has scope for further optimization). Further provides ease of manufacture, ease of transport and is cost effective. No additional assembly tools or accessories are required for the assembly of the framing assembly described in the present disclosure.

Having thus described the invention with particular reference to the preferred forms thereof, it will be obvious that various changes and modifications can be made therein without departing from the spirit and scope of the present invention as defined by the appended claims. Therefore, the embodiments described in the specification and the drawings shown in the drawings are only the most preferred embodiment of the present invention and do not represent all of the technical ideas of the present invention, various modifications that can be replaced at the time of the present application It should be understood that there may be equivalents and variations.

Note that not all of the activities described above in the general description or the examples are required, that a portion of a specific activity may not be required, and that one or more further activities may be performed in addition to those described. Still further, the order in which activities are listed is not necessarily the order in which they are performed.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Certain features, that are for clarity, described herein in the context of separate embodiments, may also be provided in combination in a single embodiment. Conversely, various features that are, for brevity, described in the context of a single embodiment, may also be provided separately or in a sub combination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

The description in combination with the figures is provided to assist in understanding the teachings disclosed herein, is provided to assist in describing the teachings, and should not be interpreted as a limitation on the scope or applicability of the teachings. However, other teachings can certainly be used in this application.

As used herein, the terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise. For example, when a single item is described herein, more than one item may be used in place of a single item. Similarly, where more than one item is described herein, a single item may be substituted for that more than one item.

Unless otherwise defined, all technical and scientific terms used herein have the same meaning as commonly understood by one of ordinary skill in the art to which this invention belongs. The materials, methods, and examples are illustrative only and not intended to be limiting. To the extent that certain details regarding specific materials and processing acts are not described, such details may include conventional approaches, which may be found in reference books and other sources within the manufacturing arts.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

LIST OF ELEMENTS

100 Structural Component
P1, P2 Parallel Strip
S1 Perpendicular Strip
110 Substantial Flat Portions
120 Void Portions
130 Convex Profile
140 Insulation Material
200 Floor Channel
210 Floor
300 Ceiling Channel
310 Ceiling
400 Construction Panel
500 Framing Assembly
600 Laminated Construction Panel
D1 Distance between Consecutive Void Portions
L Length of the Substantial Flat Portions
W Width of the Substantial Flat Portions
X First Axis

The invention claimed is:

1. A structural component for supporting at least one construction panel, the structural component comprising: an I-shaped strip comprising two parallel strips (P1, P2) and at least one strip (S1) perpendicular to (P1) and (P2), wherein at least one of the parallel strips (P1, P2) contains a plurality of substantially flat portions and a plurality of void portions, which alternate in a first direction (X) along the structural component, wherein each of the void portions contains a convex profile bordered by the strip (S1), wherein the strip (S1) comprises a plurality of alternating concave sections (C1) and convex sections (C2); wherein each substantially flat portion is configured to support the at least one construction panel in plane contact.

2. The structural component as claimed in claim 1, wherein each void portion is configured to support the at least one construction panel in line contact defined by a perimeter of the void portion.

3. The structural component as claimed in claim 1, wherein each substantially flat portion is configured to enable screws or nails to fix and abut the at least one construction panel to the structural component.

4. The structural component as claimed in claim 1, wherein one of the void portions is between each neighboring pair of the substantially flat portions.

5. The structural component as claimed in claim 1, wherein a width of each void portion is greater than a width of each substantially flat portion, the width of each void portion and the width of each substantially flat portion being measured in a direction perpendicular to first direction X and parallel to (P1) and (P1).

6. The structural component as claimed in claim 1, wherein the parallel strips (P1) and (P2) each contain a plurality of alternating substantially flat portions and void portions, with the substantially flat portions of first parallel strip (P1) being substantially parallel to the substantially flat portions of the second parallel strip (P2).

7. The structural component as claimed in claim 1, wherein the parallel strips (P1) and (P2) each contain a plurality of alternating substantially flat portions and void portions, with the void portions of the first parallel strip (P1) converging with the void portions of the second parallel strip (P2).

8. The structural component as claimed in claim 1, wherein the perpendicular strip (S1) arises centrally between the two parallel strips (P1, P2).

9. The structural component as claimed in claim 1, wherein the perpendicular strip (S1) arises along the peripheral edges of the two parallel strips (P1, P2).

10. The structural component as claimed in claim 1, wherein the void portions are arranged at an interval (D1) ranging between 30 mm to 75 mm.

11. The structural component as claimed in claim 10, wherein (D1) is greater than or equal to a length (L) of the substantially flat portions.

12. The structural component as claimed in claim 1, wherein the substantially flat portions have a width (W) ranging between 30 mm to 100 mm to support the construction panel in plane contact, (W) being measured in a direction perpendicular to first direction (X) and parallel to (P1, P2).

13. The structural component as claimed in claim 1, wherein at least at one end of at least one of (P1) and (P2) comprises the substantially flat portions.

14. The structural component as claimed in claim 1, having a thickness ranging between 0.4 mm to 1.7 mm.

15. The structural component as claimed in claim 1 comprises plastic, polymer, cardboard, wood, steel or other metals.

16. The structural component as claimed in claim 1, wherein the I-shaped strip comprises a metal.

17. The structural component as claimed in claim 1, wherein the convex profile of each of the void portions is polygonal, elliptical, circular or hexagonal.

18. The structural component as claimed in claim 1, wherein the convex profile of each of the void portions is hexagonal.

19. The structural component as claimed in claim 1, which is manufactured in whole or in part by joining two identical or symmetrical parts.

20. The structural component as claimed in claim 1, in the form of a dry wall stud.

21. The structural component as claimed in claim 1, in the form of a spacer separating two parallel bonded construction panels.

22. A wall having a framing assembly comprising:

a first horizontal framing member fixed to a floor;

a second horizontal framing member substantially parallel to and spaced from the first horizontal framing member and fixed to a ceiling;

a plurality of structural components as claimed in claim 1 spaced vertically and mounted to the first horizontal framing member at a bottom end thereof and to the second horizontal framing member at a top end thereof; and at least one construction panel, wherein each of the structural components is mounted such that substantially flat portions thereof abuts and supports surface of the construction panel in plane contact and the void portions thereof abut and support the construction panels in line contact when the at least one construction panel is fixed to one or either sides of the framing assembly.

23. The wall as claimed in claim 22, wherein for each of the structural components, one or more of the substantially flat portions proximal the bottom end thereof are fixed to the first horizontal framing member and wherein the one or more of the substantially flat portions proximal the top end thereof are fixed to the second horizontal framing member.

24. The wall as claimed in claim 22, wherein for each of the structural components, each of the void portions thereof encloses an air cavity bounded by lines of contact established by the corresponding convex profile thereof abutting the construction panel.

25. The wall as claimed in claim 22, having a heat transmittance (U-value) not exceeding 0.5 $W/m^2K$.

26. The wall as claimed in claim 22, further comprising an insulation material interposed between the construction panel and the plurality of structural components.

27. The wall as claimed in claim 22, wherein the construction panel is a gypsum board or a fibre cement board.

28. A laminated construction panel assembly comprising two opposing construction panels separated and held together by a vertically-spaced plurality of structural components as claimed in claim 1, wherein for each of the structural components, the substantially flat portions thereof supports the construction panels in plane contact, and the void portions thereof support the construction panels in line contact defined by a perimeter of the corresponding void portions.

* * * * *